US005290433A

United States Patent [19]

Chan et al.

[11] Patent Number: 5,290,433

[45] Date of Patent: Mar. 1, 1994

[54] FROTH WASHER

[75] Inventors: Edward Wing-Kee Chan, Edmonton; Robert B. Stovall, Fort McMurray, both of Canada

[73] Assignees: Alberta Energy Company Ltd.; Canadian Occidental Petroleum Ltd.; Esso Resources Canada Limited, all of Calgary; Gulf Canada Resources Limited, Toronto; Her Majesty the Queen in right of Canada, as represented by the Minister of Natural Resources, Edmonton; HBOG-Oil Sands Limited Partnership, Calgary; PanCanadian Petroleum Limited, Calgary; Petro-Canada Inc., Calgary, all of Canada

[21] Appl. No.: 748,616

[22] Filed: Aug. 22, 1991

[51] Int. Cl.[5] ..... C10G 1/04

[52] U.S. Cl. ..... 208/391; 422/259; 422/271; 422/272

[58] Field of Search ..... 208/391; 422/258, 259, 422/271, 272, 275

[56] References Cited

U.S. PATENT DOCUMENTS

| | | | |
|---|---|---|---|
| 3,784,464 | 1/1974 | Kaminsky | 208/391 |
| 4,255,410 | 3/1981 | Spevack | 422/258 |
| 4,343,691 | 8/1982 | Minkkinen | 208/391 |

*Primary Examiner*—R. Bruce Breneman
*Assistant Examiner*—P. L. Hailey
*Attorney, Agent, or Firm*—Millen, White, Zelano & Branigan

[57] ABSTRACT

The washer comprises an open-topped vessel having a tube mounted vertically and centrally therein. Post-primary bitumen froth is fed to the upper end of the tube. Pairs of down throw and up throw propellers mounted to rotate in the tube act to shear the froth as it passes down through the tube. At its lower end, the tube is closed off by a transverse wall. Slots are formed in the tube side wall to provide an exit. The sheared mixture thus changes direction as it leaves the tube. In the vessel chamber, solids and water sink downwardly and are removed as tailings through a bottom outlet. The sheared aerated bitumen rises and forms a new forth that is recovered in a launder. Middlings are withdrawn from the chamber and recycled to join the feed. The product froth is reduced in water and solids relative to the feed froth.

4 Claims, 3 Drawing Sheets

FROTH WASHER

FIELD OF THE INVENTION

This invention relates to a method for cleaning bitumen froth by removing some of its contained water and solids. It further relates to a froth cleaner for carrying out the method.

PRIOR ART

The present invention is an improvement of the froth leaner and process practiced therein, which are disclosed by V. P. Kaminsky in U.S. Pat. No. 3,784,464, owned by the present assignees.

Before commenting on the Kaminsky system, it is appropriate to provide some background on what post-primary bitumen froth is and how it is produced.

There are very large deposits of oil sands in the Athabasoa region of Alberta. These oil sands are strip mined and the valuable heavy oil (often referred to as "bitumen") is extracted using a process referred to as the hot water process. Generally stated, the hot water process involves the following.

The as-mined oil sand is mixed with hot water and caustic in a horizontal rotating drum or tumbler for a few minutes. As a result of heating the oil sand slurry, generating surfactants in situ by reaction of caustic with components of the oil, and mechanically applying energy, the separation of the oil from the solids and its dispersion into the aqueous phase is facilitated. At the same time, air bubbles are entrained in the produced slurry as a result of cascading it in the tumbler. Some of these air bubbles become attached to liberated bitumen bubbles, thus rendering them floatable;

The slurry issuing from the tumbler outlet is screened, to remove rocks and oversized lumps, and is then diluted with additional hot water;

The diluted mixture is continuously settled for about 45 minutes in a very large, open -topped vessel having a cylindrical upper section and a conical bottom section. This vessel is referred to as the primary separation vessel ("PSV"). In the tumbler and PSV, more of the oil globules become aerated. As a result, the oil is floatable and rises by buoyancy to the top of the PSV to form an oily froth. This mechanism can be referred to as "spontaneous flotation". The froth overflows the top rim of the PSV and is received in and led away by a channel or launder. At the same time, the coarse sand particles sink and are concentrated in the conical section of the PSV An underflow, referred to as "primary tailings", is removed through a bottom outlet of the PSV. In the mid-section of the PSV, there exists a watery mixture comprising some non-buoyant oil and fine solids—this mixture is referred to as "middlings". The primary tailings and middlings each contain a minor amount of oil which needs to be recovered;

the middlings are mixed with the primary tailings and the mixture is introduced into a cone settler referred to as the tailings oil recovery vessel ("TORV"). In the TORV, the feed mixture is deflected radially as it is fed in and is spread outwardly and horizontally. The out-moving mixture is contacted from below by an upwelling stream of aerated middlings (all of this is described in detail in U.S. Pat. No. 4,545,892). The result is that a second yield of froth is produced as the two streams mix. This middling recirculation/aeration recovers bitumen from the PSV tailings and middlings which would otherwise be lost. The froth overflows the rim of the TORV and is recovered. It is referred to as a form of "post-primary froth";

A stream of middlings is withdrawn from the TORV and is processed in a bank of sub-aerated, impeller-agitated flotation cells. Under these conditions of intense aeration and agitation, a third oil froth is produced and recovered. This froth is also classed as "post-primary froth".

The two streams of post-primary froth, either separately or in combination, provide the feedstock for the present invention.

It needs to be realized that the post-primary froth streams are highly contaminated with water and solids. A typical composition (which can vary widely) is:

bitumen—40% by weight
water—52% by weight
solids—8% by weight

It is necessary to remove these contaminants before delivering the oil stream to a refinery-like upgrading plant. This is conventionally done by de-aerating the froth, diluting the deaerated froth with naphtha and then treating the deaerated diluted stream in two stages of driven centrifugation, to firstly remove the coarse solids with scroll centrifuges and then remove the fine solids and water with disc centrifuges.

The centrifuging circuit is expensive and difficult to operate. The abrasive solids cause severe wear of the centrifuges.

It would be desirable to remove some of the water and solids prior to centrifugation. This would alleviate the production limitation imposed by the centrifugation plants.

The Kaminsky patent disclosed a system, comprising a cleaner and its inherent method, for treating post-primary froth. The objective for the system was to reduce the water and solids contents of the froth, prior to centrifugation. The Kaminsky cleaner involved:

an upstanding open-topped outer vessel having a cylindrical upper section and a conical lower section, said vessel having an outlet at its base;

an upstanding, open-ended draft tube centrally positioned in the upper section of the outer vessel; and a driven shaft carrying a pair of marine-type propellers, the upper propeller being adapted to compress or "throw" fluid downwardly and the lower propeller being adapted to throw it upwardly. The two opposed pitch impellors create an intense shear field which would function to break up the large bitumen globules into smaller dispersed droplets. The feed slurry would flow down the draft tube into the vessel by gravity.

In the operation of the washer:

water was added to the froth as it was being delivered to the upper inlet end of the draft tube;

the froth/wash water mixture was then mixed and sheared by the propellers;

the sheared mixture moved out of the open bottom end of the draft tube into the bottom section of the outer vessel chamber, which provided the quiescent environment of a settler. Water and solids, liberated by the shearing action, would be separated from the dispersed bitumen droplets. The droplets would rise through the annular upper section chamber by buoyancy and form a froth reduced in solids and water. This froth would overflow the outer vessel rim and be recovered; and solids and water would move downwardly by gravity and be removed through the bottom outlet.

SUMMARY OF THE INVENTION

In accordance with the present invention a modified froth cleaner of the Kaminsky type is provided wherein the draft tube is closed at its bottom end by a transverse wall and upwardly extending slots are formed in the sidewall of the lower end of the tube, to provide the outlet from the tube.

It has been found that the oil loss with the underflow from the cleaner can be reduced from about 6% by weight, for a cleaner having an open-bottomed draft tube, to about 2% or less for the same cleaner modified in accordance with the present invention.

It is believed that the improvement in performance is explained by the following:

It appears necessary that quiescent conditions be maintained in the main body of fluid outside the draft tube, in order to promote flotation/settling separation of the froth components and to reduce oil losses by entrainment in the tailings;

When an open-bottomed draft tube is used, a vortex is generated in the fluid undergoing the propeller-driven mixing. This vortex extends down into the settling section of the vessel chamber and disturbs the fluid undergoing flotation/settling separation, thereby increasing the likelihood that oil will be lost through the bottom tailings outlet;

By providing transverse closure of the draft tube, the disturbing action of the vortex is eliminated;

Since the direction of flow is straight down with the open-bottomed prior art draft tube, there is a tendency for feed to short-circuit and oil to be lost with the tailings. By changing the direction of fluid flow as it leaves the draft tube, by blocking it with the transverse wall and causing it to move radially out through the slots, a stagnation point flow condition is induced. This change in turbulent structure is believed to be beneficial to the separation process. When the flow exits from the slots, the distribution is such that the oil globules are more concentrated at the top of the exit slots and the sand is more concentrated at the bottom of the slots.

In a preferred feature, middlings from the vessel chamber are recirculated and added to the froth feed incoming to the draft tube. Recirculation of the middlings has enabled elimination of fresh water addition to the incoming feed.

Broadly stated the invention is a method for cleaning post-primary bitumen froth feed containing bitumen associated with water and solids contaminants, comprising: providing apparatus comprising an upstanding open-topped vessel having a tubular upper section and a conical lower section, said vessel forming a chamber communicating at its base with means for removing solids-rich underflow, said vessel having a substantially vertical tube positioned in its upper section whereby said vessel and tube form an annular passage between them, as part of the chamber, said tube having an upper portion, in which shearing of the froth takes place, and a lower outlet portion through which the sheared froth leaves the tube, said tube forming a bore, said outlet portion having a transverse wall closing the lower end of the tube bore, said outlet portion forming slots in its side wall, which slots extend upwardly from the transverse wall and provide an outlet for the sheared froth, said tube having a rotatable shaft extending downwardly into the tube bore, said shaft carrying at least one pair of vertically spaced apart propellers, the upper propeller being adapted to down throw the feed, the lower propeller being adapted to up throw the feed; introducing the froth feed into the upper end of the tube, whereby it moves down through the tube bore; shearing the froth in the tube bore with the propellers as it moves downwardly therethrough; causing the sheared froth to change direction from downward flow to outward radial flow as it exits through the slots; temporarily retaining the sheared froth under quiescent conditions in the vessel chamber, whereby buoyant bitumen in the sheared froth rises through the annular space to form froth product reduced in water and solids content, relative to the froth feed; recovering the newly-formed froth product from the vessel; and continuously withdrawing fluidized solids from the base of the vessel.

DESCRIPTION OF THE PREFERRED EMBODIMENT

Figure 1:
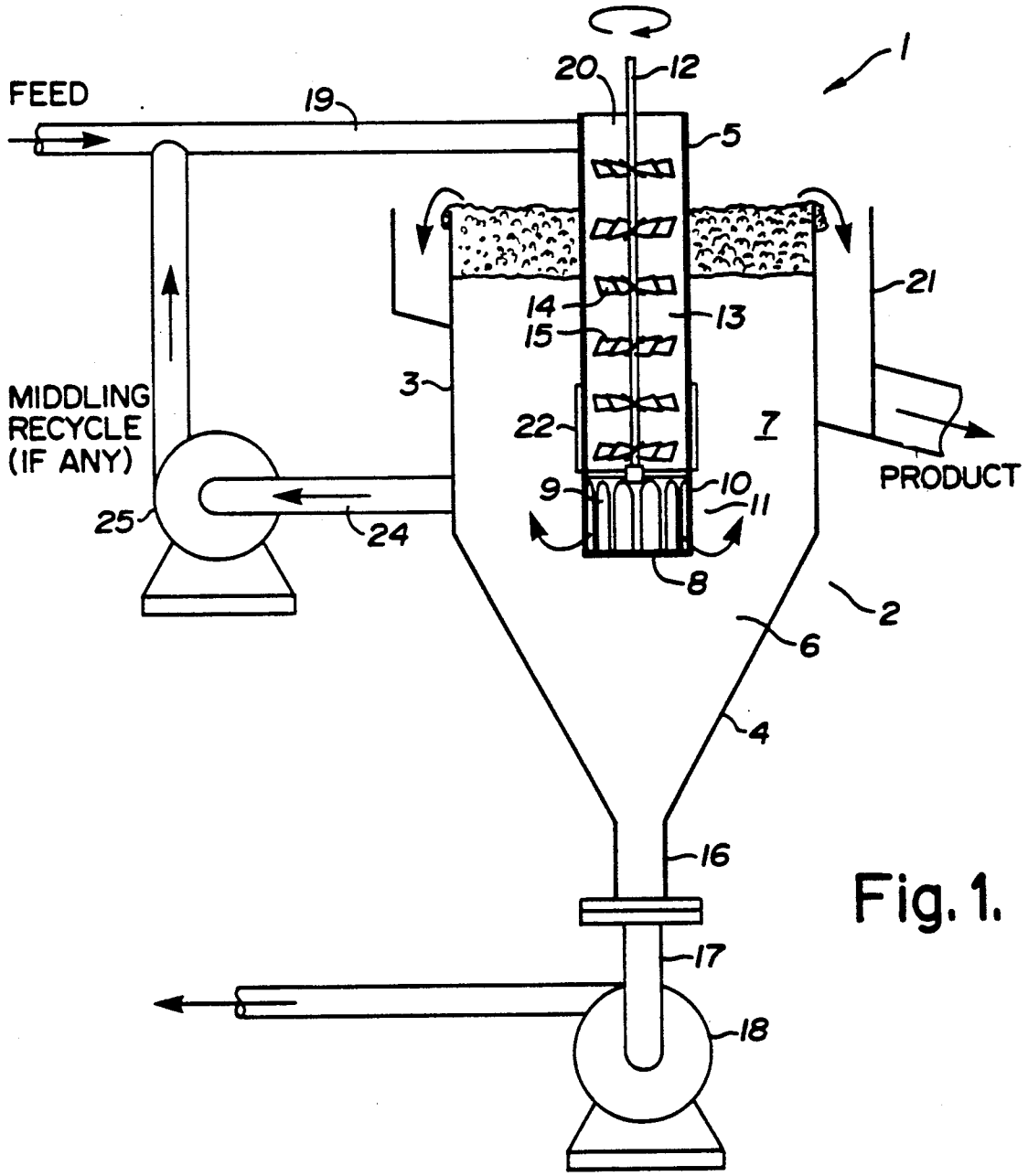
FIG. 1 is a sectional side view of a froth cleaner in accordance with the invention.
Figure 2:
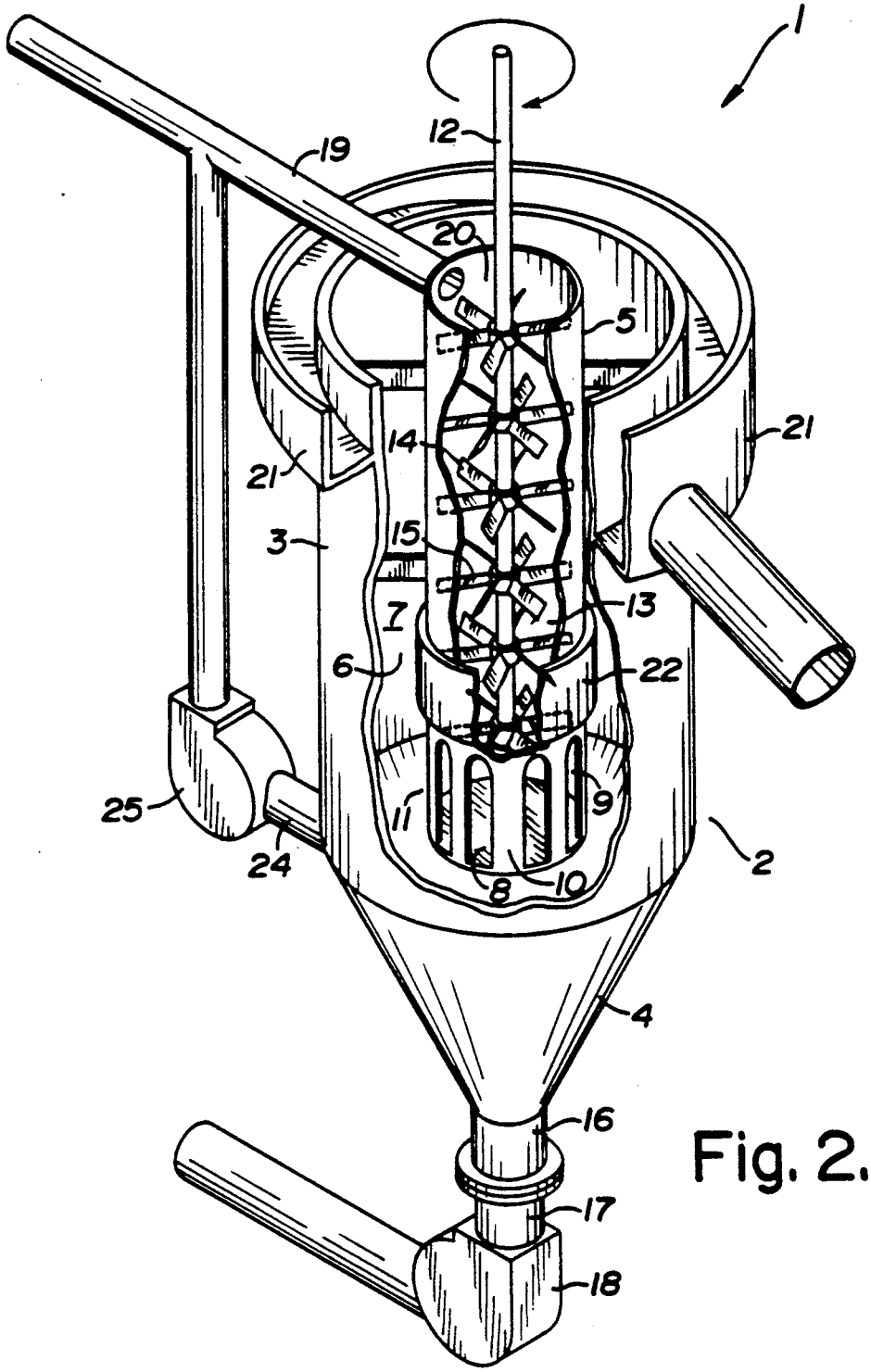
FIG. 2 is a perspective partly broken away view of the froth cleaner of FIG. 1.

The froth cleaner comprises an upstanding outer vessel 2 having a tubular upper section 3 and a conical lower section 4.

A vertical tube 5 is centrally positioned and supported so as to extend coaxially into the chamber 6 of the vessel 2. The lower end of the tube 5 is landed at about the junction of the vessel sections 3, 4.

The vessel chamber 6 includes an annular passage 7 formed between the tube 5 and vessel section 3.

The tube 5 is open at its upper end and closed by a transverse wall 8 at its lower end.

Circumferentially spaced apart, vertical slots 9 are formed by the side wall 10 of the lower outlet portion 11 of the tube 5.

A rotatable driven shaft 12 extends downwardly into the bore 13 of the tube 5. The shaft 12 carries a plurality of pairs of propellers. Each pair comprises an upper propeller 14, operative to throw or compress fluid downwardly, and a lower propeller 15, operative to throw fluid upwardly. The propellers are designed so that there is a net downward flow.

The vessel's lower section 4 has a bottom outlet 16 connected by a line 17 with a withdrawal pump 18.

Means, such as a line 19, are provided to feed post-primary froth to the open end 20 of the tube 5.

A launder 21 extends around the vessel 2 at its upper end, to receive and remove produced froth.

A vertically slidable sleeve 22 is mounted around the tube 5. The sleeve 22 may be lowered or raised by cables (not shown) to adjust the open area of the slots 9.

A middlings recycle line 24 connects the vessel chamber 6 with the feed line 19. A pump 25 is positioned in the line 24 to recycle middlings to the line 19 and tube 5.

In operation, post-primary froth is fed continuously into the open upper end 20 of the tube 5. It may be diluted by recycle of middlings from the vessel chamber 6. The froth is mixed and sheared by the opposed pairs of propellers 14, 15 as it moves down through the tube 5. In the course of this action, the globules of oil are sheared and broken up into much smaller globules, with a concomitant liberation of some of the water and solids associated with the original globules. Some attachment of air bubbles to the dispersed bitumen droplets also occurs in the turbulent mixing zone inside the bore 13 of the tube 5, due to the formation of fine air bubbles. This process increases the bitumen/air bubble attachment efficiency.

As the stream of froth exits the tube 5, it changes direction, as it is blocked from continuing downwards by the wall 8 and must leave through the slots 9.

In the course of changing direction, the buoyant oil globules and sinking solids particles tend to stratify due to gravity.

On exiting the slots 9, the sheared mixture enters the chamber 6, wherein it is temporarily retained under quiescent conditions. The aerated oil globules rise through the fluid in the annular passage 7 and form froth which overflows into the launder 21 and is recovered. The solids and water tend to sink, are concentrated in the conical section and are withdrawn by the pump 18 through the line 19.

The efficacy of the modified cleaner is demonstrated by the following example.

EXAMPLE 1

Pilot data from froth cleaning tests using the present washer/settler is provided in Table 2. Data from the Kaminsky froth washer is provided in Table 1 for comparison.

A comparison of these two data sets revealed similar feed compositions. Kaminsky's data averaged: 40.3% oil, 49.2% water and 10.5% solids. The feed composition for the test involving the present washer averaged 36.9% oil, 37.4% water and 25.3% solids.

The processing conditions for the present tests were more severe than in Kaminsky's case, with a feed loading rate averaged at 1927 versus the rate of 953 kg/m$^2$.min in Kaminsky's experiments. This loading is defined by mass flow rate of the feed per cross section area of the mixing zone. Kaminsky's washer was characterized by having a larger settling area, with a loading of 244 kg/m$^2$.min versus 273 kg/m$^2$.min in the present case. Wash water was used to enhance the washing efficiency in Kaminsky's tests, at a rate of 27 lb. of fresh water per 100 lb. of bitumen, which is equivalent to 16 lb. of fresh water per 100 lb. of froth, assuming washed froth to contain 60% bitumen. With the present mixer/-settler, fresh water addition was not required.

Figure 3:
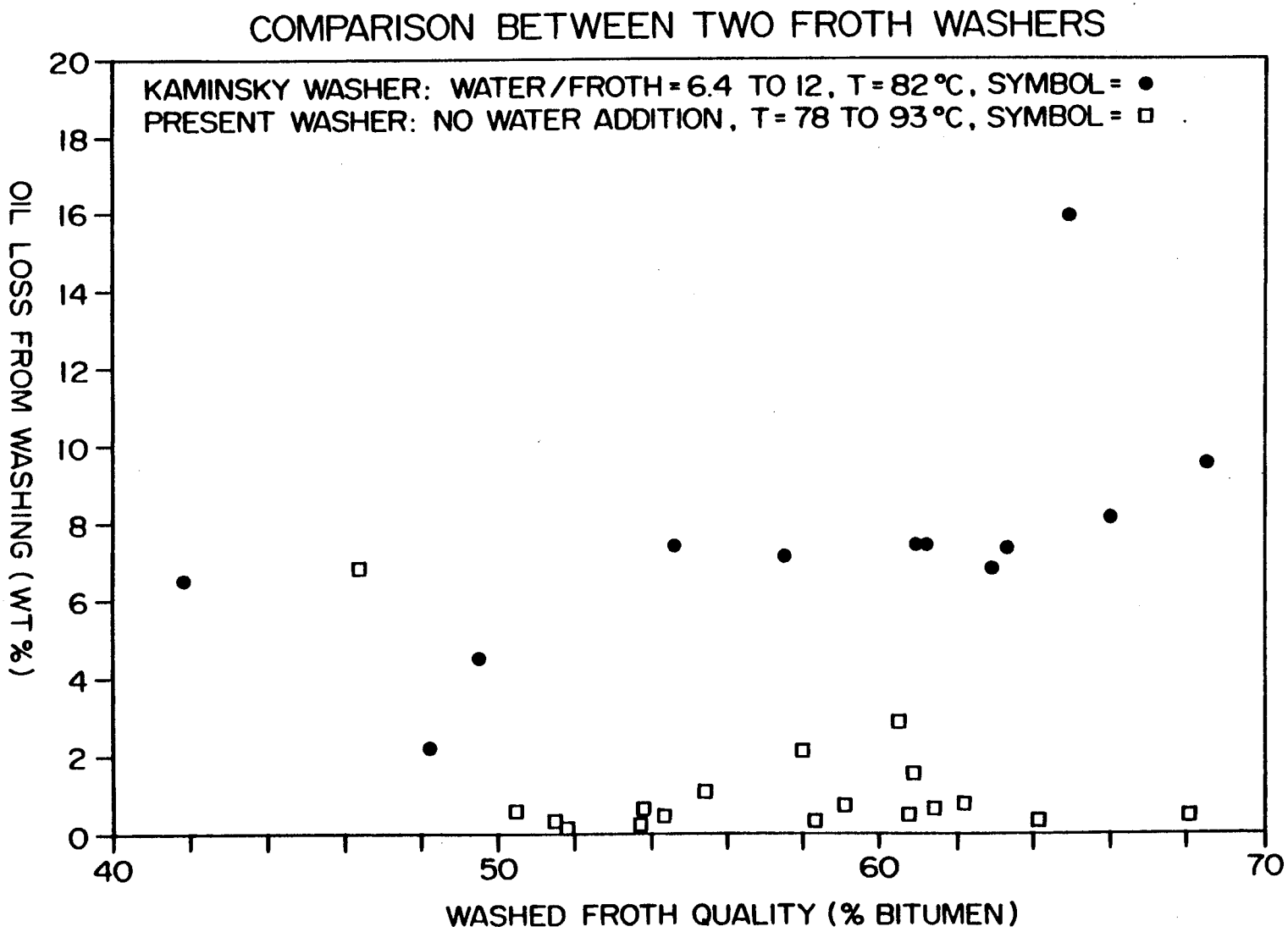
FIG. 3 is a plot comparing washed froth quality of the prior art Kaminsky washer and the present washer.

The data of Tables 1 and 2 are plotted in FIG. 3. The data shows that the present washer design out-performed the prior art design. At equivalent washed froth quality, the oil loss with tails in the runs using the present washer averaged 1%. The oil loss with tails in the prior art washer runs averaged 7%.

TABLE 1

| Typical Feed composition | Average Feed Rate |
|---|---|
| 40.3% Oil<br>49.2% Water<br>10.5% Solids | 953 kg/m2 · min (based on mixer area)<br>244 kg/m2 · min (based on settler area) |

| Run # | Feed T (deg. C.) | Impellor Tip Speed (rpm) | (% Oil) | Washed F Composition (% Water) | (Solids) | Oil Losses (%) |
|---|---|---|---|---|---|---|
| 477 | 54.4 | 300 | 37.6 | 57.2 | 5.2 | 4.8 |
| 477 | 54.4 | 600 | 41.8 | 52.8 | 5.4 | 6.5 |
| 477 | 54.4 | 900 | 60.9 | 33.3 | 5.8 | 7.4 |
| 477 | 54.4 | 1200 | 63.3 | 31.7 | 5.0 | 7.3 |
| 478 | 82.2 | 800 | 54.6 | 38.0 | 7.4 | 7.4 |
| 478 | 82.2 | 800 | 57.5 | 35.9 | 6.6 | 7.1 |
| 478 | 82.2 | 800 | 70.2 | 26.3 | 3.5 | 11.6 |
| 479 | 71.1 | 800 | 66.0 | 28.3 | 5.7 | 8.1 |
| 479 | 71.1 | 800 | 64.9 | 30.3 | 4.8 | 15.9 |
| 479 | 71.1 | 800 | 61.2 | 32.9 | 5.9 | 7.4 |
| 479 | 71.1 | 1200 | 68.5 | 26.2 | 5.3 | 9.5 |
| 479 | 71.1 | 1200 | 62.9 | 29.8 | 7.3 | 6.8 |
| 480 | 71.1 | 800 | 49.5 | 44.9 | 5.6 | 4.5 |
| 481 | 54.4 | 800 | 48.2 | 45.0 | 6.8 | 2.2 |

*washed water = (lb. of water)/(lb. of washed froth

TABLE 2

| Averaged Feed composition | Average Feed Rate |
|---|---|
| 36.9% Oil<br>37.4% Water<br>25.3% Solids | 1927 kg/m2 · min (based on mixer area)<br>273 kg/m2 · min (based on settler area)<br>Wash Water: none |

| Run # | Feed T (deg. C.) | Middling Recycle Rate (kg/min) | (% Oil) | Feed Composition (% Water) | (Solids) | (% Oil) | Washed Froth Composition (% Water) | (Solids) | Oil Losses (%) |
|---|---|---|---|---|---|---|---|---|---|
| 1 | 74 | 32 | 38.4 | 39.0 | 22.6 | 51.8 | 37.6 | 10.6 | 0.13 |
| 2 | 81 | 32 | 40.7 | 41.0 | 18.4 | 54.3 | 35.4 | 10.3 | 0.45 |
| 3 | 81 | 32 | 38.4 | 40.6 | 20.9 | 59.1 | 29.9 | 10.9 | 0.72 |
| 4 | 71 | 32 | 31.1 | 49.6 | 19.3 | 60.8 | 28.8 | 10.3 | 0.87 |
| 5 | 86 | N/A | 37.7 | 38.0 | 24.3 | 53.9 | 33.4 | 12.8 | 0.37 |
| 6 | 83 | N/A | 38.5 | 34.1 | 27.4 | 46.4 | 41.4 | 12.2 | 4.12 |
| 7 | 85 | N/A | 33.9 | 37.7 | 28.4 | 58.0 | 30.4 | 11.6 | 2.39 |
| 8 | 83 | 20 | 31.8 | 45.3 | 22.9 | 60.9 | 28.0 | 11.2 | 1.54 |
| 9 | 68 | 32 | 31.0 | 42.4 | 26.6 | 58.3 | 32.7 | 8.9 | 0.75 |
| 10 | 70 | 32 | 40.4 | 34.9 | 24.7 | 58.3 | 32.2 | 9.5 | 0.30 |
| 11 | 83 | 32 | 41.6 | 39.1 | 19.3 | 60.5 | 30.3 | 9.3 | 2.86 |
| 12 | 83 | N/A | 42.7 | 39.0 | 18.3 | 62.2 | 29.0 | 8.8 | 0.76 |
| 13 | 83 | 12 | 41.7 | 28.8 | 19.5 | 61.4 | 29.4 | 9.2 | 0.63 |
| 14 | 76 | N/A | 33.6 | 42.6 | 23.8 | 50.5 | 38.5 | 11.1 | 0.65 |
| 15 | 89 | N/A | 28.6 | 34.6 | 36.8 | 64.2 | 28.6 | 7.2 | 0.55 |
| 16 | 86 | N/A | 39.0 | 35.0 | 26.0 | 68.1 | 25.3 | 6.6 | 0.44 |
| 17 | 67 | N/A | 27.4 | 35.4 | 37.2 | 60.5 | 26.9 | 12.6 | 0.86 |
| 18 | 68 | N/A | 43.1 | 32.4 | 24.5 | 50.0 | 29.4 | 24.5 | 0.09 |
| 19 | 69 | N/A | 49.0 | 29.9 | 21.0 | 50.3 | 31.3 | 18.4 | 0.20 |
| 20 | 63 | N/A | 38.5 | 37.2 | 24.3 | 49.8 | 40.4 | 9.9 | 0.23 |

TABLE 2-continued

| | | | | | | | | | |
|---|---|---|---|---|---|---|---|---|---|
| 21 | 72 | N/A | 39.3 | 36.1 | 24.6 | 55.4 | 35.3 | 9.3 | 0.49 |
| 22 | 82 | 32 | 26.1 | 34.1 | 39.8 | 64.3 | 26.6 | 9.1 | 6.36 |
| 23 | ? | 32 | 25.5 | 33.0 | 41.5 | 62.6 | 28.7 | 8.7 | 2.53 |
| 24 | ? | 32 | 42.4 | 36.7 | 20.9 | 58.8 | 30.9 | 10.4 | 0.41 |
| 25 | 75 | 32 | 33.7 | 35.9 | 30.5 | 53.6 | 34.9 | 11.5 | 0.41 |
| 26 | ? | 32 | 38.6 | 38.9 | 22.5 | 51.6 | 36.7 | 11.7 | 0.51 |

The embodiments of the invention in which an exclusive property or privilege is claimed are defined as follows:

1. Apparatus for cleaning post-primary froth feed containing bitumen, water and solids, comprising:

an open-topped vessel having a tubular upper section and a conical bottom section communicating at its base with means for underflow removal, said vessel forming a chamber and having means at its upper end for receiving and removing froth overflowing the vessel's rim;

an upstanding open-topped tube forming a bore and being positioned in the upper section of the vessel in spaced relation with the vessel side wall to cooperate therewith to form an annular passage, said tube being associated with means for introducing forth feed in to the upper end of the tube bore, said tube having a slot-free upper portion extending the major part of the tube's length in which shearing and aeration of the froth takes place, and a lower outlet portion extending the balance of the tube's length and having a transverse wall closing its lower end, the side wall of the lower outlet portion forming a plurality of slots extending up from the transverse wall, said slots providing outlet means through which sheared froth may leave the tube bore, and a driven rotatable shaft extending down into the bore of the upper portion of the tube, said shaft carrying one or more pairs of opposed throw propellers in vertically spaced arrangement, each pair consisting of a downthrow propeller positioned above an up throw propeller.

2. The apparatus as set forth in claim 1 comprising:

means for recycling middlings from the vessel chamber to the means for introducing froth feed.

3. A method for cleaning post-primary bitumen froth feed containing bitumen associated with water and solids contaminants, comprising:

providing apparatus comprising an upstanding open-topped vessel having a tubular upper section and a conical lower section, said vessel forming a chamber communicating at its base with means for removing solids-rich underflow, said vessel having a substantially vertical open-topped tube positioned in its upper section whereby said vessel and tube form an annular passage between them, as part of the chamber, said tube having a slot-free upper portion extending the majority of the tube's length in which shearing of the froth takes place, and a lower outlet portion extending the balance of the tube's length through which the sheared froth leaves the tube, said tube forming a bore, said lower outlet portion having a transverse wall closing the lower end of the tube bore, the side wall of the lower outlet portion forming slots which extend upwardly from the transverse wall and provide an outlet for the sheared froth, said tube having a rotatable shaft extending downwardly into the tube bore, said shaft carrying at least one pair of vertically spaced apart propellers, the upper propeller being adapted to down throw the feed, the lower propeller being adapted to up throw the feed;

introducing the froth feed into the upper end of the tube, whereby it moves down through the tube bore;

shearing the froth in the tube bore with the propellers as it moves downwardly therethrough;

causing the sheared froth to change direction from downward flow to outward radial flow as it exits through the slots;

temporarily retaining the sheared froth under quiescent conditions in the vessel chamber, whereby buoyant bitumen in the sheared froth rises through the annular space to form froth product reduced in water an lids content, relative to the froth feed;

recovering the new formed froth product from the vessel; and continuously withdrawing fluidized solids from the base of the vessel.

4. The apparatus as set forth in claim 3 comprising:

withdrawing fluid from the chamber and recycling it and adding it to the froth feed being introduced into the tube.

* * * * *